US010655399B2

(12) United States Patent
Cook, III et al.

(10) Patent No.: US 10,655,399 B2
(45) Date of Patent: May 19, 2020

(54) MAGNETIC POSITIONING OF REINFORCING PARTICLES WHEN FORMING METAL MATRIX COMPOSITES

(71) Applicant: Halliburton Energy Services, Inc., Houston, TX (US)

(72) Inventors: Grant O. Cook, III, Spring, TX (US); Jeffrey G. Thomas, Magnolia, TX (US); Garrett T. Olsen, The Woodlands, TX (US); Seth Garrett Anderle, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/751,145

(22) PCT Filed: Sep. 22, 2015

(86) PCT No.: PCT/US2015/051429
§ 371 (c)(1),
(2) Date: Feb. 7, 2018

(87) PCT Pub. No.: WO2017/052509
PCT Pub. Date: Mar. 30, 2017

(65) Prior Publication Data

US 2018/0230755 A1 Aug. 16, 2018

(51) Int. Cl.
*E21B 10/60* (2006.01)
*B22F 7/00* (2006.01)
(Continued)

(52) U.S. Cl.
CPC ..... *E21B 10/602* (2013.01); *B22F 7/008* (2013.01); *E21B 10/42* (2013.01); *E21B 10/55* (2013.01);
(Continued)

(58) Field of Classification Search
CPC ..... E21B 10/602; E21B 10/55; E21B 10/42; B22F 7/008; B22F 2202/05
See application file for complete search history.

(56) References Cited

U.S. PATENT DOCUMENTS 6,461,401 B1 10/2002 Kembaiyan et al.
8,865,000 B2 10/2014 Michailovski et al.
(Continued)

FOREIGN PATENT DOCUMENTS

AU 2010295220 B2 3/2011
DE 69516722 T2 11/2000
(Continued)

OTHER PUBLICATIONS

International Search Report and Written Opinion from PCT/US2015/051429, dated Jul. 5, 2016, 17 pages.

*Primary Examiner* — Kristyn A Hall
(74) *Attorney, Agent, or Firm* — Alan Bryson; C. Tumey Law Group PLLC

(57) ABSTRACT

A metal matrix composite (MMC) may be formed with two or more portions each having different reinforcing particles that enhance strength, wear resistance, or both of their respective portions of the MMC. Selective placement of the different reinforcing particles may be achieved using magnetic members. For example, in some instances, forming an MMC may involve placing reinforcement materials within an infiltration chamber of a mold assembly, the reinforcement materials comprising magnetic reinforcing particles and non-magnetic reinforcing particles; positioning one or more magnetic members relative to the mold assembly to selectively locate the magnetic reinforcing particles within the infiltration chamber with respect to the non-magnetic reinforcing particles; and infiltrating the reinforcement materials with a binder material to form a hard composite.

16 Claims, 9 Drawing Sheets

(51) Int. Cl.

| | |
|---|---|
| ***E21B 10/42*** | (2006.01) |
| ***E21B 10/55*** | (2006.01) |
| *B22F 7/06* | (2006.01) |
| *B22F 5/00* | (2006.01) |

(52) U.S. Cl.
CPC ... *B22F 2005/001* (2013.01); *B22F 2007/066* (2013.01); *B22F 2202/05* (2013.01); *B22F 2999/00* (2013.01)

(56) References Cited

U.S. PATENT DOCUMENTS

| | | | | |
|---|---|---|---|---|
| 8,911,522 | B2 | 12/2014 | Cleboski et al. | |
| 2010/0290849 | A1 | 11/2010 | Mirchandani | |
| 2011/0210283 | A1* | 9/2011 | Ramirez | B23K 35/025 252/62.55 |
| 2011/0290566 | A1 | 12/2011 | Mirchandani et al. | |
| 2013/0316149 | A1 | 11/2013 | Atkins et al. | |
| 2015/0008271 | A1 | 1/2015 | Mack | |

FOREIGN PATENT DOCUMENTS

| | | | | |
|---|---|---|---|---|
| KR | 10-2013-0076478 | | 7/2013 | |
| WO | WO-2012006281 | A2 | 1/2012 | |
| WO | WO2013180695 | * | 12/2013 | E21B 10/36 |

* cited by examiner

MAGNETIC POSITIONING OF REINFORCING PARTICLES WHEN FORMING METAL MATRIX COMPOSITES

BACKGROUND

A wide variety of tools are used in the oil and gas industry for forming wellbores, in completing drilled wellbores, and in producing hydrocarbons such as oil and gas from completed wells. Examples of these tools include cutting tools, such as drill bits, reamers, stabilizers, and coring bits; drilling tools, such as rotary steerable devices and mud motors; and other tools, such as window mills, tool joints, and other wear-prone tools. These tools, and several other types of tools outside the realm of the oil and gas industry, are often formed as metal matrix composites (MMCs), and are referred to herein as "MMC tools."

Cutting tools, in particular, are frequently used to drill oil and gas wells, geothermal wells, and water wells. For example, fixed-cutter drill bits are often formed with a composite bit body (sometimes referred to in the industry as a matrix bit body), having cutting elements or inserts disposed at select locations about the exterior of the matrix bit body. During drilling, these cutting elements engage the subterranean formation and remove adjacent portions thereof.

MMCs used in a matrix bit body of a fixed-cutter bit are generally erosion-resistant and exhibit high impact strength. However, some portions of the matrix bit body may be more prone to erosion when engaging the surrounding formation and may, therefore, benefit from greater erosion-resistance. Other portions of the matrix bit body, however, may be more prone to cracking from mechanical stresses conveyed during drilling and may, therefore, benefit from greater impact strength.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure relates to tool manufacturing and, more particularly, to using magnetic particles and/or magnetic partitions to selectively place reinforcing particles during the formation of a metal matrix composite (MMC), and thereby enhance erosion-resistance or impact strength in selected portions of the resulting MMC.

Embodiments of the present disclosure are applicable to any tool or part formed as an MMC. For instance, the principles of the present disclosure may be applied to the fabrication of tools or parts commonly used in the oil and gas industry for the exploration and recovery of hydrocarbons. Such tools and parts include, but are not limited to, oilfield drill bits or cutting tools (e.g., fixed-angle drill bits, roller-cone drill bits, coring drill bits, bi-center drill bits, impregnated drill bits, reamers, stabilizers, hole openers, cutters), non-retrievable drilling components, aluminum drill bit bodies associated with casing drilling of wellbores, drill-string stabilizers, cones for roller-cone drill bits, models for forging dies used to fabricate support arms for roller-cone drill bits, arms for fixed reamers, arms for expandable reamers, internal components associated with expandable reamers, sleeves attached to an uphole end of a rotary drill bit, rotary steering tools, logging-while-drilling tools, measurement-while-drilling tools, side-wall coring tools, fishing spears, washover tools, rotors, stators and/or housings for downhole drilling motors, blades and housings for downhole turbines, and other downhole tools having complex configurations and/or asymmetric geometries associated with forming a wellbore.

It will be appreciated, however, that the principles of the present disclosure may be equally applied to other MMC tools or parts used outside of the oil and gas industry. For instance, the methods described herein may be applied to fabricating armor plating, automotive components (e.g., sleeves, cylinder liners, driveshafts, exhaust valves, brake rotors), bicycle frames, brake fins, aerospace components (e.g., landing-gear components, structural tubes, struts, shafts, links, ducts, waveguides, guide vanes, rotor-blade sleeves, ventral fins, actuators, exhaust structures, cases, frames, fuel nozzles), turbopump components, a screen, a filter, and a porous catalyst, without departing from the scope of the disclosure. Those skilled in the art will readily appreciate that the foregoing list is not a comprehensive listing, but only exemplary. Accordingly, the foregoing listing of parts and/or components should not be limiting to the scope of the present disclosure.

Figure 1:
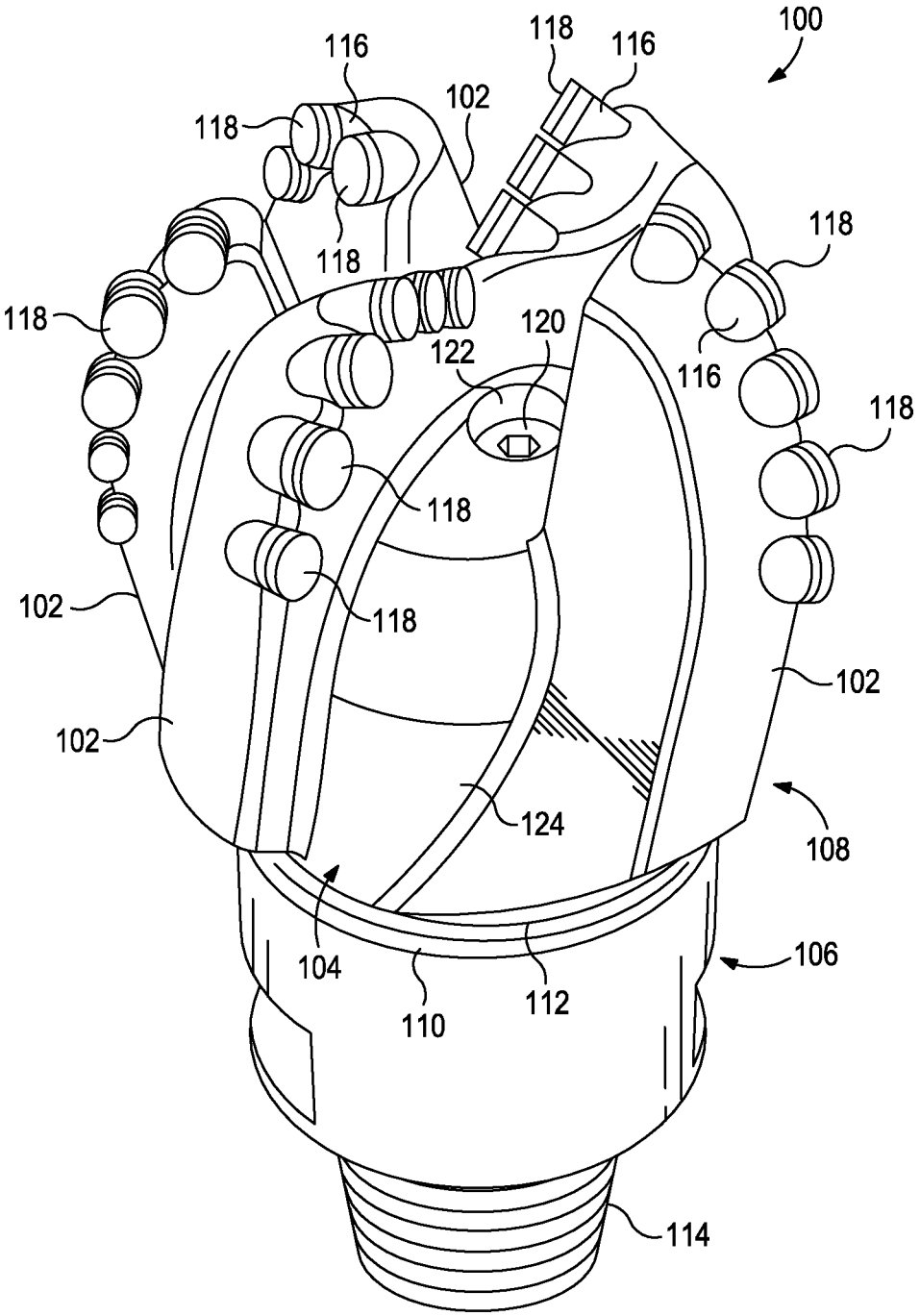
FIG. 1 is a perspective view of an exemplary drill bit that can incorporate the principles of the present disclosure.

Referring to FIG. 1, illustrated is a perspective view of an example MMC tool 100 that may be fabricated in accordance with the principles of the present disclosure. The MMC tool 100 is generally depicted in FIG. 1 as a fixed-cutter drill bit that may be used in the oil and gas industry to drill wellbores. Accordingly, the MMC tool 100 will be referred to herein as the "drill bit 100," but, as indicated above, the drill bit 100 may alternatively be replaced with any type of MMC tool or part used in the oil and gas industry or any other industry, without departing from the scope of the disclosure.

As illustrated in FIG. 1, the drill bit 100 may include or otherwise define a plurality of cutter blades 102 arranged along the circumference of a bit head 104. The bit head 104 is connected to a shank 106 to form a bit body 108. The shank 106 may be connected to the bit head 104 by welding, such as using laser arc welding, which results in the formation of a weld 110 formed within a weld groove 112. The shank 106 may further include or otherwise be connected to a threaded pin 114, such as an American Petroleum Institute (API) drill pipe thread.

In the depicted example, the drill bit 100 includes five cutter blades 102, in which multiple recesses or pockets 116 are formed. A cutting element 118 may be fixedly installed within each recess 116. This can be done, for example, by brazing each cutting element 118 into a corresponding recess 116. As the drill bit 100 is rotated in use, the cutting elements 118 engage the rock and underlying earthen materials, to dig, scrape or grind away the material of the formation being penetrated.

During drilling operations, drilling fluid or "mud" can be pumped downhole through a drill string (not shown) coupled to the drill bit 100 at the threaded pin 114. The drilling fluid circulates through and out of the drill bit 100 at one or more nozzles 120 positioned in nozzle openings 122 defined in the bit head 104. Junk slots 124 are formed between each adjacent pair of cutter blades 102. Cuttings, downhole debris, formation fluids, drilling fluid, etc., may pass through the junk slots 124 and circulate back to the well surface within an annulus formed between exterior portions of the drill string and the inner wall of the wellbore being drilled.

Figure 2:
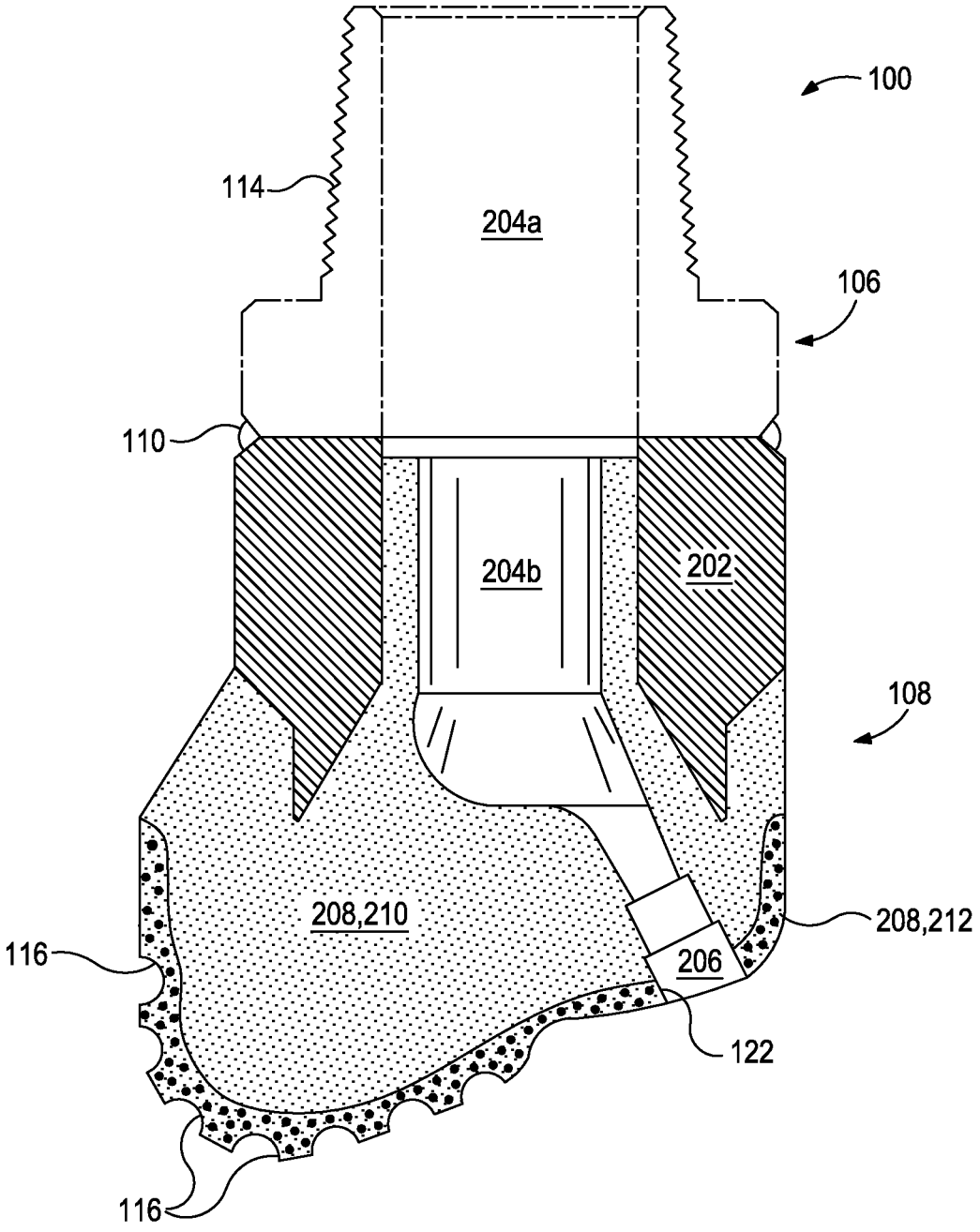
FIG. 2 is a cross-sectional view of the drill bit of FIG. 1.

FIG. 2 is a cross-sectional side view of the drill bit 100 of FIG. 1. Similar numerals from FIG. 1 that are used in FIG. 2 refer to similar components that are not described again. As illustrated, the shank 106 may be securely attached to a metal blank (or mandrel) 202 at the weld 110 and the metal blank 202 extends into the bit body 108. The shank 106 and the metal blank 202 are generally cylindrical structures that define corresponding fluid cavities 204*a* and 204*b*, respectively, in fluid communication with each other. The fluid cavity 204*b* of the metal blank 202 may extend longitudinally into the bit body 108. At least one flow passageway 206 (one shown) may extend from the fluid cavity 204*b* to exterior portions of the bit body 108. The nozzle openings 122 (one shown in FIG. 2) may be defined at the ends of the flow passageways 206 at the exterior portions of the bit body 108. The pockets 116 are formed in the bit body 108 and are shaped or otherwise configured to receive the cutting elements 118 (FIG. 1).

In accordance with the teachings of the present disclosure, and as described in more detail below, the bit body 108 may comprise a hard composite portion 208 that is formed of a metal matrix reinforced with multiple types of reinforcing particles. As illustrated, the hard composite portion 208 has a first portion 210 and a second portion 212, each having different types or configurations of reinforcing particles. The second portion 212 is illustrated at the exterior of the hard composite portion 208, such as at the pockets 116, which is the exterior portion of the cutter blades 102. Due to contact with the formation during drilling, the cutter blades 102 are prone to erosion. Generally, smaller reinforcing particles provide greater impact strength and elongated reinforcing particles (e.g., fibers) mitigate crack propagation whereas larger particles provide increased erosion resistance. Accordingly, the reinforcing particles in the first portion 210 of the hard composite portion 208 may include elongated particles and/or particles smaller than the reinforcing particles in the second portion 212. For example, the reinforcing particles in the first portion 210 may be 0.1 micron to 100 microns, and the reinforcing particles in the second portion 212 may be 100 microns to 1000 microns such that the reinforcing particles in the first portion 210 are smaller than the reinforcing particles in the second portion 212. In another example, the reinforcing particles in the first and second portions 210, 212 may be approximately the same size with the first portion 210 further including fibers. In yet another example, the reinforcing particles in the first portion 210 may include both fibers and particles smaller than the reinforcing particles in the second portion 212.

Figure 3:
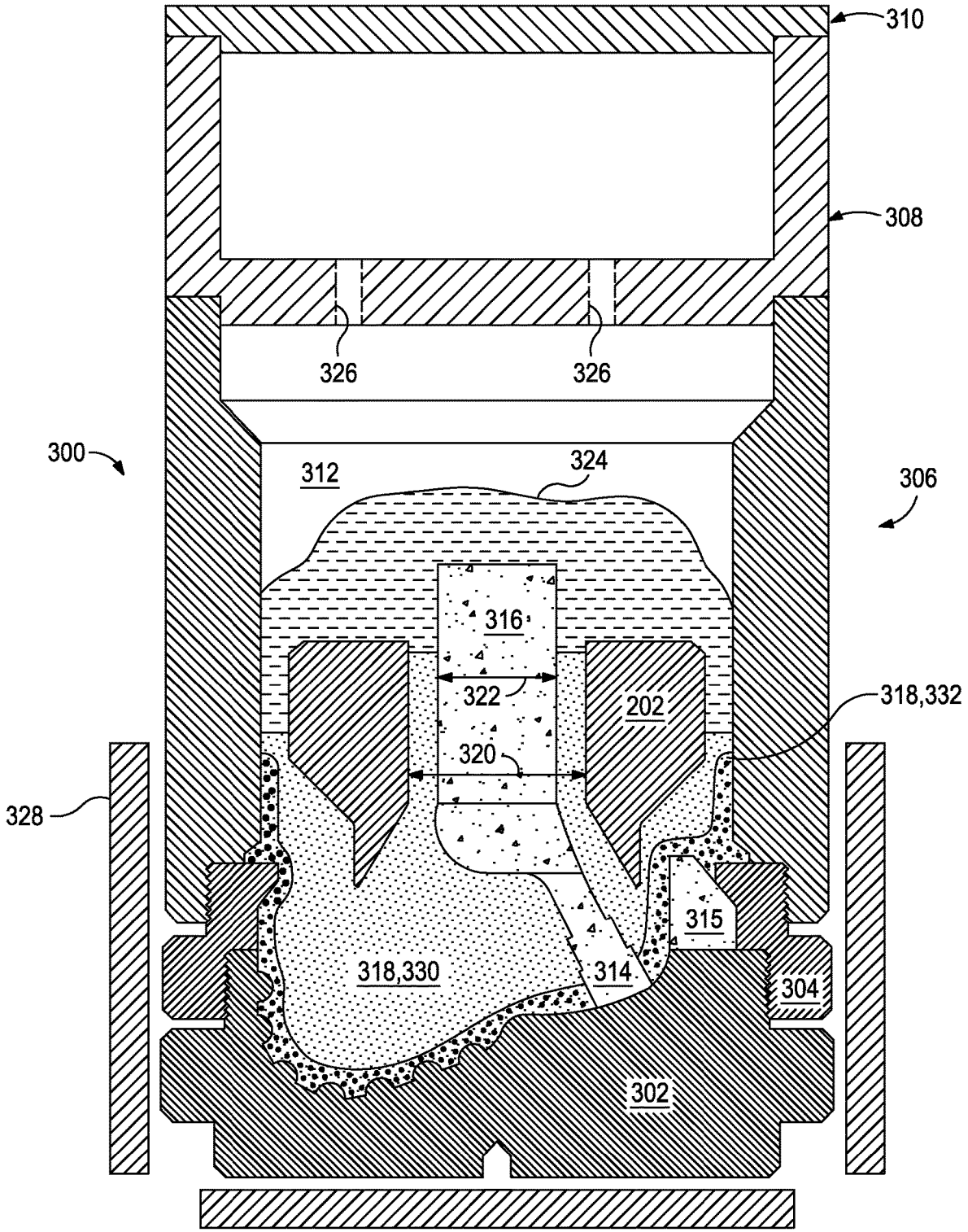
FIG. 3 is a cross-sectional side view of an exemplary mold assembly for use in forming the drill bit of FIG. 1.

FIG. 3 is a cross-sectional side view of a mold assembly 300 that may be used to form the drill bit 100 of FIGS. 1 and 2. While the mold assembly 300 is shown and discussed as being used to help fabricate the drill bit 100, those skilled in the art will readily appreciate that varying configurations of the mold assembly 300 may be used in fabricating any of the MMC tools and parts mentioned herein, without departing from the scope of the disclosure. As illustrated, the mold assembly 300 may include several components such as a mold 302, a gauge ring 304, and a funnel 306. In some embodiments, the funnel 306 may be operatively coupled to the mold 302 via the gauge ring 304, such as by corresponding threaded engagements, as illustrated. In other embodiments, the gauge ring 304 may be omitted from the mold assembly 300 and the funnel 306 may instead be operatively coupled directly to the mold 302, such as via a corresponding threaded engagement, without departing from the scope of the disclosure.

In some embodiments, as illustrated, the mold assembly 300 may further include a binder bowl 308 and a cap 310 placed above the funnel 306. The mold 302, the gauge ring 304, the funnel 306, the binder bowl 308, and the cap 310 may each be made of or otherwise comprise graphite or alumina ($Al_2O_3$), for example, or other suitable materials. An infiltration chamber 312 may be defined within the mold assembly 300. Various techniques may be used to manufacture the mold assembly 300 and its components, such as machining graphite blanks to produce the various components and thereby define the infiltration chamber 312 to exhibit a negative or reverse profile of desired exterior features of the drill bit 100 (FIGS. 1 and 2).

Materials, such as consolidated sand or graphite, may be positioned within the mold assembly 300 at desired locations to form various features of the drill bit 100 (FIGS. 1 and 2). For example, one or more nozzle displacements or legs 314 (one shown) may be positioned to correspond with desired locations and configurations of the flow passageways 206 (FIG. 2) and their respective nozzle openings 122 (FIGS. 1 and 2). One or more junk slot displacements 315 may also be positioned within the mold assembly 300 to correspond with the junk slots 124 (FIG. 1). Moreover, a cylindrically-shaped central displacement 316 may be placed on the legs 314. The number of legs 314 extending from the central displacement 316 will depend upon the desired number of flow passageways and corresponding nozzle openings 122 in the drill bit 100. Further, cutter-pocket displacements (shown as part of mold 302 in FIG. 3) may be placed in the mold 302 to form cutter pockets 116.

After the desired materials, including the central displacement 316 and the legs 314, have been installed within the mold assembly 300, reinforcement materials 318 may then be placed within or otherwise introduced into the mold assembly 300. The reinforcement materials 318 may include various types and sizes of reinforcing particles. According to the present disclosure, and as described in greater detail below, some reinforcing particles of the reinforcement materials 318 may be magnetic while others are non-magnetic. As used herein, and unless otherwise specified, the term "reinforcing particles" refers to both the magnetic and non-magnetic reinforcing particles. As used herein, the term "magnetic particle" refers to a particle that react to a magnetic field, whether provided by a permanent magnet or an electromagnetic field. Magnetic particles may or may not have magnetic fields associated therewith.

The magnetism, or lack thereof, of the reinforcing particles allows for selective placement of the reinforcing particles within the mold assembly 300 relative to one or more magnetic members 328 used in conjunction with the mold assembly 300. Placement of the magnetic members 328 may vary, depending on the desired placement of the reinforcing particles. For instance, the magnetic members 328 may be contained in the infiltration chamber 312, integral to the mold assembly 300 or components thereof, integral to the materials positioned within the infiltration chamber 312 (e.g., the legs 314, the central displacement 316, and the metal blank 202), external to the mold assembly 300, or any combination thereof.

Magnetic members 328 may be permanent magnets (e.g., ferromagnets, composite magnets, or rare-earth magnets), temporary magnets (e.g., some iron alloys), superconductors, or electromagnets (i.e., a magnetic field produced by an electric current).

In the embodiment of FIG. 3, the magnetic members 328 are depicted as being positioned exterior to the mold assembly 300 adjacent the mold 302, the gauge ring 304, and a portion of the funnel 306 adjacent to the gauge ring 304. The illustrated reinforcement materials 318 include non-magnetic particles 330 and magnetic particles 332. The magnetic fields emitted by the magnetic members 328 may draw the magnetic particles 332 toward the inner walls of the mold 302, the gauge ring 304, and the portion of the funnel 306. Accordingly, along with the placement of the non-magnetic particles 330, the magnetic members 328 may assist in maintaining the magnetic particles 332 in their location as the desired amount of reinforcing materials 318 are added to the mold 300.

Suitable non-magnetic reinforcing particles include, but are not limited to, particles of metals, metal alloys, superalloys, intermetallics, borides, carbides, nitrides, oxides, ceramics, diamonds, and the like, or any combination thereof that are nonmetallic at the temperature at which the mold assembly 300 is loaded with the reinforcing particles. Examples of reinforcing particles suitable for use in conjunction with the embodiments described herein may include particles that include, but are not limited to, tungsten, molybdenum, niobium, tantalum, rhenium, iridium, ruthenium, beryllium, titanium, chromium, rhodium, uranium, nitrides, silicon nitrides, boron nitrides, cubic boron nitrides, natural diamonds, synthetic diamonds, cemented carbide, spherical carbides, low-alloy sintered materials, cast carbides, silicon carbides, boron carbides, cubic boron carbides, molybdenum carbides, titanium carbides, tantalum carbides, niobium carbides, chromium carbides, vanadium carbides, iron carbides, tungsten carbides, macrocrystalline tungsten carbides, cast tungsten carbides, crushed sintered tungsten carbides, carburized tungsten carbides, austenitic steels, ceramics, chromium alloys, any mixture thereof, and any combination thereof.

Suitable magnetic reinforcing particles include, but are not limited to, cobalt, CoFe, iron, $Fe_2Br$, SmCo, $Ni_3Fe$, $Fe_2O_3$, $NiFe_2O_4$, $Fe_3O_4$, $ZnFe_2O_4$, $Ni_3Mn$, $Fe_3Al$, $CuFe_2O_4$, $MgFe_2O_4$, $FePd_3$, $CoFe_2O_4$, MnBi, $Cu_2MnAl$, nickel, $Fe_3S_4$, $Fe_7S_8$, MnSb, $CrPt_3$, MnB, $MnFe_2O_4$, $Y_3Fe_5O_{12}$, $Cu_2MnIn$, $CrO_2$, $ZnCMn_3$, $MnPt_3$, MnAs, gadolinium, $AlCMn_3$, terbium, $Au_2MnAl$, dysprosium, EuO, TbN, $Au_4V$, $CrBr_3$, DyN, thulium, holmium, EuS, erbium, $Sc_3In$, $GdCl_3$, any alloy thereof, and any combination thereof. Exemplary magnetic alloys may include ferritic steel, carbon steel, maraging steel, stainless steel, alloyed steel, tool steel, Fe—P alloy, Fe—Si alloy, Fe—Si—Al alloy, Ni—Fe alloy, Fe—Ni—Mo alloy, Fe—Cr alloy, Fe—Co alloy, Fe—Nd—B alloy, Ni—Al—Cu alloy, Co—Ni—Al—Cu alloy, Co—Ni—Al—Cu—Ti alloy, Co—Sm alloy, spinel ferrites (e.g., $Mn_{0.5}Zn_{0.5}Fe_2O_4$ and $Ni_{0.3}Zn_{0.7}Fe_2O_4$), and rare-earth iron garnets. The magnetic strength of magnetic reinforcing particles generally decreases with increasing temperature up to its Curie temperature. Therefore, when using magnetic materials like gadolinium having a Curie temperature 289-293K and $Au_2MnAl$ having a Curie temperature 200K, the mold assembly 300 may be cooled while loading the reinforcing particles therein. Additional suitable magnetic reinforcing particles include, but are not limited to, superconducting materials, such as boron-doped diamond, lanthanum, niobium, technetium, $C_6Ca$, $C_6Li_3Ca_2$, $C_{60}Cs_2Rb$, $C_{60}K_3$, $C_{60}Rb_x$, $MgB_2$, $Nb_3Al$, $Nb_3Ge$, NbN, $Nb_3Sn$, NbTi, ZrN, any alloy thereof, and any combination thereof.

In some instances, magnetic reinforcing particles may comprise non-magnetic particles at least partially coated with a magnetic material (e.g., the composition of the foregoing magnetic reinforcing particles). In some instances, magnetic and non-magnetic reinforcing particles may be bonded together in a cluster with glue or a binder material described herein. Alternatively, magnetic reinforcing particles may comprise magnetic particles at least partially coated with a non-magnetic material wherein the magnetic core provides suitable magnetism to the particle and the outer non-magnetic layer protects the magnetic core from the infiltrating binder.

The reinforcing particles described herein may exhibit a size and general diameter range from 0.1 micron to 1000 microns (e.g., 0.1 micron to 10 microns, 1 micron to 100 microns, 1 micron to 500 microns, 10 microns to 100 microns, 50 microns to 500 microns, 100 microns to 1000 microns, 250 microns to 1000 microns, or 500 microns to 1000 microns). In some embodiments, especially in cases where the reinforcing particles described herein are fabricated via additive manufacturing techniques, the size and general diameter of some of the reinforcing particles can be larger than 1000 microns, such as about 2 mm in diameter.

The metal blank 202 may be supported at least partially by the reinforcement materials 318 within the infiltration chamber 312. More particularly, after a sufficient volume of the reinforcement materials 318 has been added to the mold assembly 300, the metal blank 202 may then be placed within mold assembly 300. The metal blank 202 may include an inside diameter 320 that is greater than an outside diameter 322 of the central displacement 316, and various fixtures (not expressly shown) may be used to position the metal blank 202 within the mold assembly 300 at a desired location. The reinforcement materials 318 may then be filled to a desired level within the infiltration chamber 312.

Binder material 324 may then be placed on top of the reinforcement materials 318, the metal blank 202, and the core 316. Suitable binder materials 324 include, but are not limited to, copper, nickel, cobalt, iron, aluminum, molybdenum, chromium, manganese, tin, zinc, lead, silicon, tungsten, boron, phosphorous, gold, silver, palladium, indium, any mixture thereof, any alloy thereof, and any combination thereof. Non-limiting examples of the binder material 324 may include copper-phosphorus, copper-phosphorous-silver, copper-manganese-phosphorous, copper-nickel, copper-manganese-nickel, copper-manganese-zinc, copper-manganese-nickel-zinc, copper-nickel-indium, copper-tin-manganese-nickel, copper-tin-manganese-nickel-iron, gold-nickel, gold-palladium-nickel, gold-copper-nickel, silver-copper-zinc-nickel, silver-manganese, silver-copper-zinc-cadmium, silver-copper-tin, cobalt-silicon-chromium-nickel-tungsten, cobalt-silicon-chromium-nickel-tungsten-boron, manganese-nickel-cobalt-boron, nickel-silicon-chromium, nickel-chromium-silicon-manganese, nickel-chromium-silicon, nickel-silicon-boron, nickel-silicon-chromium-boron-iron, nickel-phosphorus, nickel-manganese, copper-aluminum, copper-aluminum-nickel, copper-aluminum-nickel-iron, copper-aluminum-nickel-zinc-tin-iron, and the like, and any combination thereof. Examples of commercially-available binder materials 324 include, but are not limited to, VIRGIN™ Binder 453D (copper-manganese-nickel-zinc, available from Belmont Metals, Inc.), and copper-tin-manganese-nickel and copper-tin-manganese-nickel-iron grades 516, 519, 523, 512, 518, and 520 available from ATI Firth Sterling.

In some embodiments, the binder material 324 may be covered with a flux layer (not expressly shown). The amount of binder material 324 (and optional flux material) added to the infiltration chamber 312 should be at least enough to infiltrate the reinforcement materials 318 during the infiltration process. In some instances, some or all of the binder material 324 may be placed in the binder bowl 308, which may be used to distribute the binder material 324 into the infiltration chamber 312 via various conduits 326 that extend therethrough. The cap 310 (if used) may then be placed over the mold assembly 300. The mold assembly 300 and the materials disposed therein may then be preheated and then placed in a furnace (not shown). When the furnace temperature reaches the melting point of the binder material 324, the binder material 324 will liquefy and proceed to infiltrate the reinforcement materials 318.

After a predetermined amount of time allotted for the liquefied binder material 324 to infiltrate the reinforcement materials 318, the mold assembly 300 may then be removed from the furnace and cooled at a controlled rate. Once cooled, the mold assembly 300 may be broken away to expose the bit body 108 (FIGS. 1 and 2) that includes the hard composite portion 208 (FIG. 2). Subsequent processing according to well-known techniques may be used to finish the drill bit 100 (FIG. 1).

Figure 4:
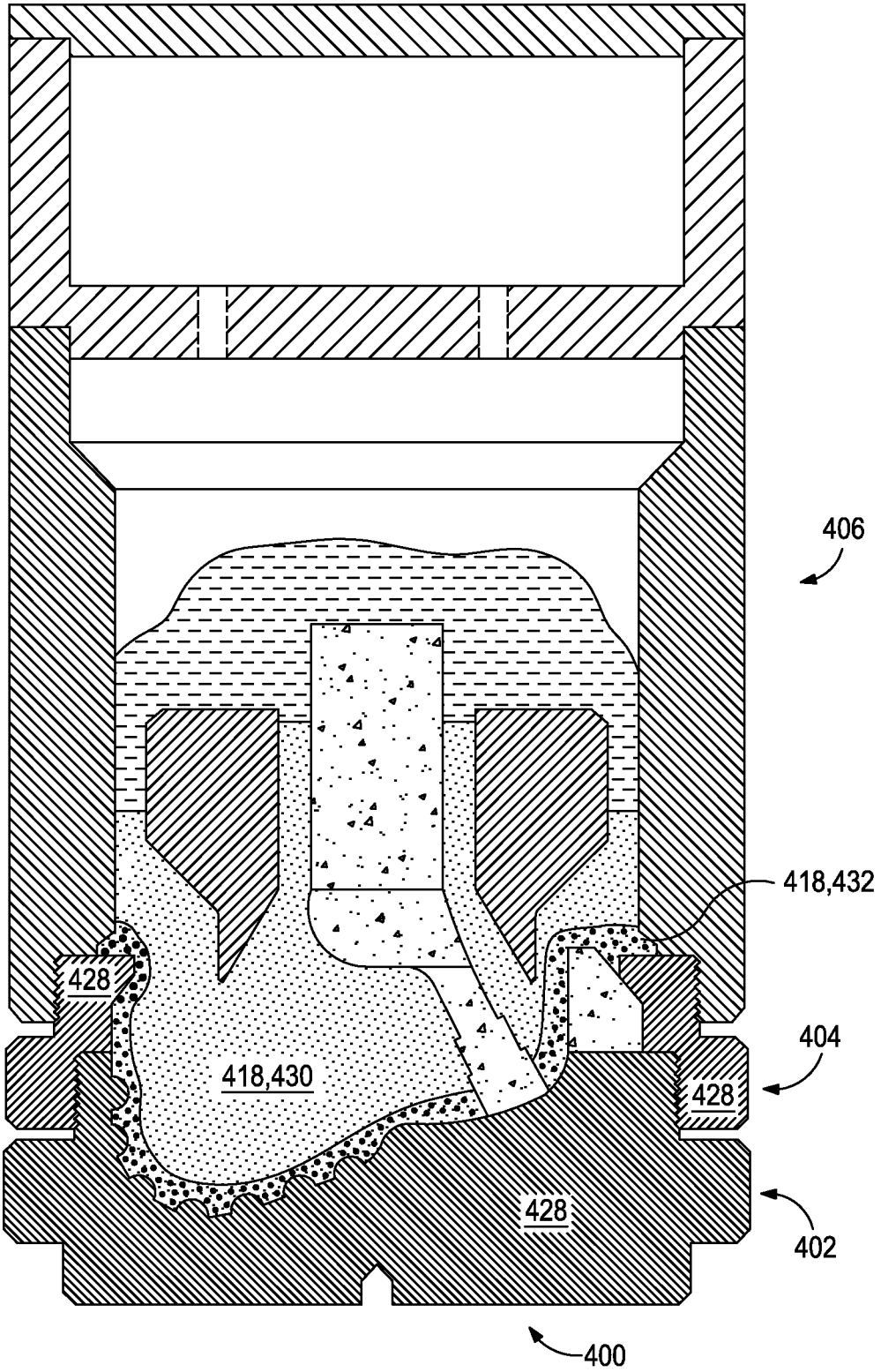
FIG. 4 is a cross-sectional side view of another exemplary mold assembly for use in forming the drill bit of FIG. 1.

FIG. 4 is a cross-sectional side view of another exemplary mold assembly 400 for use in forming a drill bit. As illustrated, the mold assembly 400 may include several components such as a mold 402, a gauge ring 404, and a funnel 406. In some embodiments, the funnel 406 may be operatively coupled to the mold 402 via the gauge ring 404, such as by corresponding threaded engagements, as illustrated. As described relative to FIG. 3, other arrangements of the mold assembly 400 are contemplated without departing from the scope of the disclosure including arrangements that eliminate one or more of the foregoing components.

In the illustrated mold assembly 400, the mold 402 and gauge ring 404 have magnetic members 428 integral thereto or are otherwise made of a magnetic material. The magnetic members 428, along with gravity and the placement of the non-magnetic reinforcing particles 430, assist in maintaining the magnetic reinforcing particles 432 at or near the inner surfaces of the mold 402 and gauge ring 404 during infiltration. The resultant drill bit, consequently, would have the magnetic reinforcing particles 432 positioned at the exterior of the cutter blades where the foregoing examples of reinforcing particles 318 operate to enhance impact strength and mitigate crack propagation.

FIGS. 3 and 4 use magnetic particles to segregate the reinforcing material 318, 418 to achieve the first and second portions 210, 212 of the hard composite portion 208 illustrated in FIG. 2. Alternatively, magnetic partitioning barriers may be used to segregate the reinforcing material 318, 418.

Figure 5A:
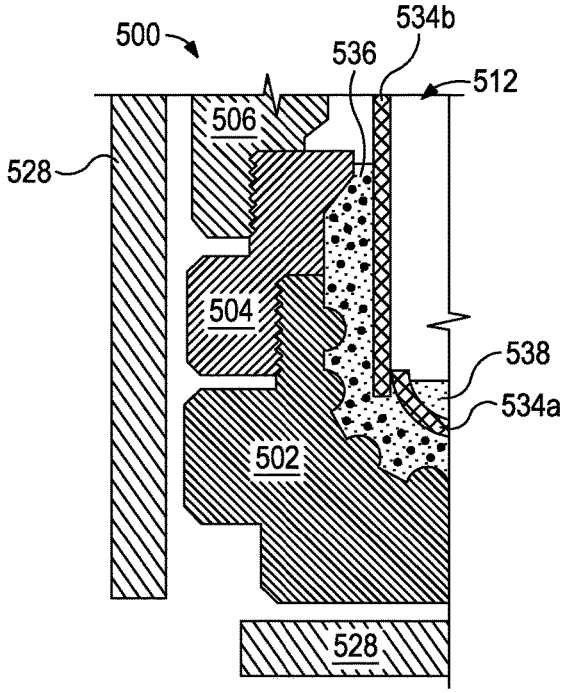
FIGS. 5A-D is a cross-sectional side view of another exemplary mold assembly for use in forming the drill bit of FIG. 1.

FIGS. 5A-5D, for example, schematically illustrate at least some of the steps of a method for segregating reinforcing materials with magnetic partitioning barriers 534*a,b* in cross-sectional side views of a portion of another exemplary mold assembly 500. The illustrated portion of the mold assembly 500 includes a mold 502, a gauge ring 504, and a funnel 506. Magnetic members 528 are included exterior to the mold assembly 500. In FIG. 5A, first reinforcing particles 536 are placed between the magnetic partitioning barriers 534*a,b* and a portion of the mold cavity (illustrated as the mold 502 and the gauge ring 504). The magnetic field of the magnetic members 528 hold the magnetic partitioning barriers 534*a,b* and, consequently, the first reinforcing particles 536 in place. The first reinforcing particles 536 may include non-magnetic particles, magnetic particles, or a combination thereof. Second reinforcing particles 538 are progressively added to the infiltration chamber opposite the magnetic partitioning barriers 534*a,b* from the first reinforcing particles.

Figure 5B:
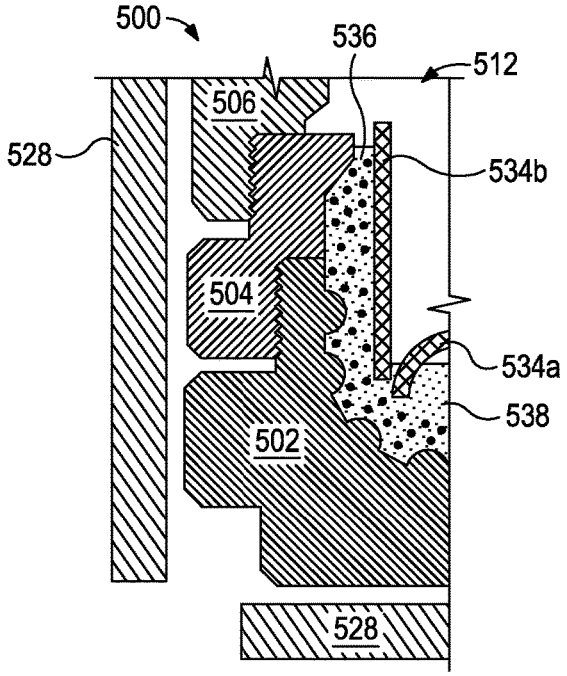

Once the infiltration chamber 512 is filled with the second reinforcing particles 538 such that the level of second reinforcing particles 538 is at an overlap between the two magnetic partitioning barriers 534*a,b,* as illustrated in FIG. 5B, the first magnetic partitioning barrier 534*a* is removed from the infiltration chamber 512. That is, once the second reinforcing particles 538 have been added to a level that they may physically maintain the first reinforcing particles 536 in position, the first magnetic partitioning barrier 534*a* may be removed.

Figure 5C:
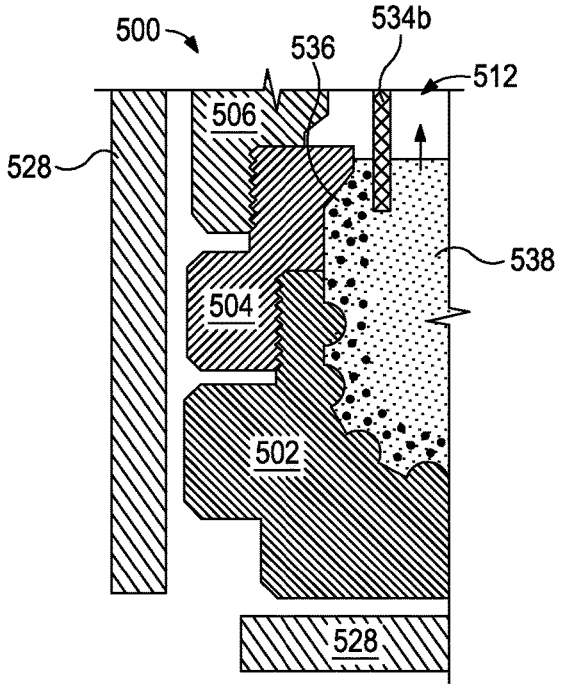
Figure 5D:
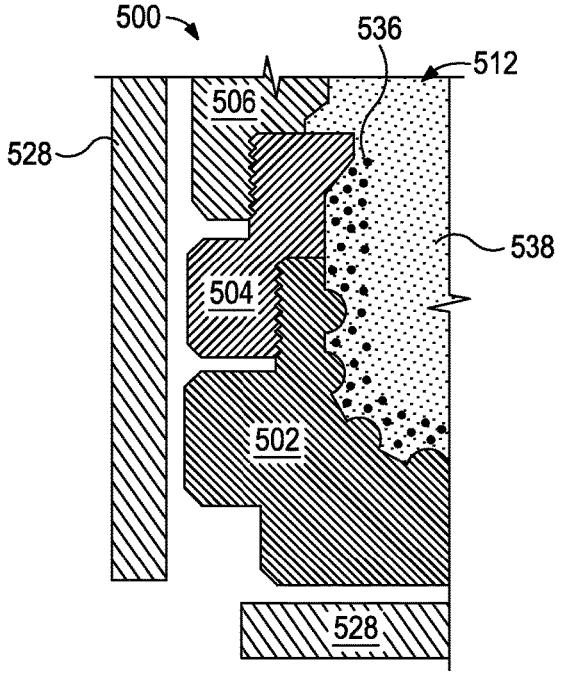

Additional second reinforcing particles 538 may then be added to the infiltration chamber 512 to a level at or close to the level of the first reinforcing particles 536. As illustrated in FIG. 5C, the second magnetic partitioning barrier 534*b* is removed from the infiltration chamber 512. Finally, FIG. 5D illustrates that the remaining second reinforcing particles 538 are added to the infiltration chamber 512 to the desired final level. The magnetic partitioning method illustrated in FIGS. 5A-5D also produces the first and second portions 210, 212 of the hard composite portion 208 illustrated in FIG. 2.

Figure 6:
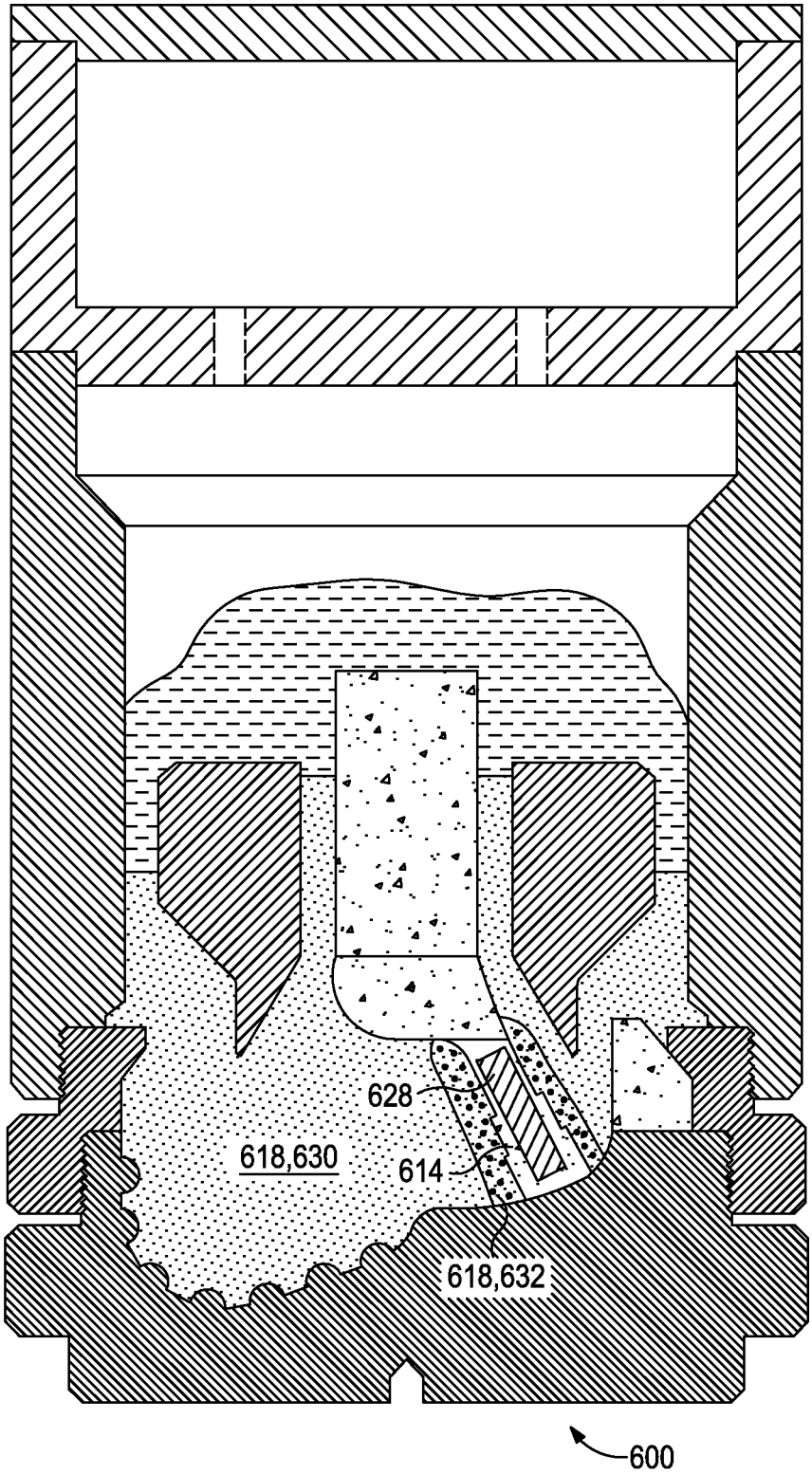
FIG. 6 is a cross-sectional side view of another exemplary mold assembly for use in forming the drill bit.
Figure 7:
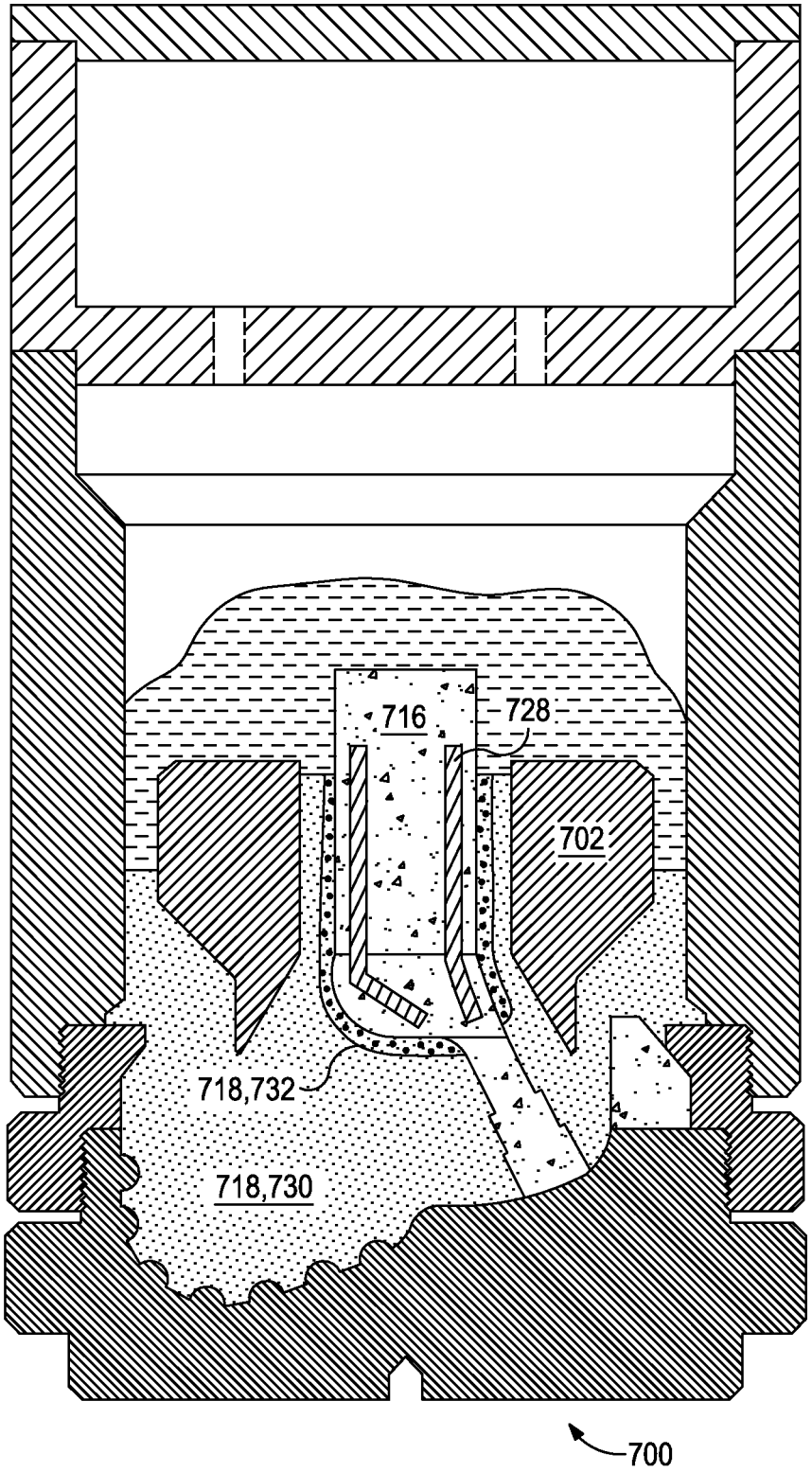
FIG. 7 is a cross-sectional side view of another exemplary mold assembly for use in forming the drill bit.
Figure 8:
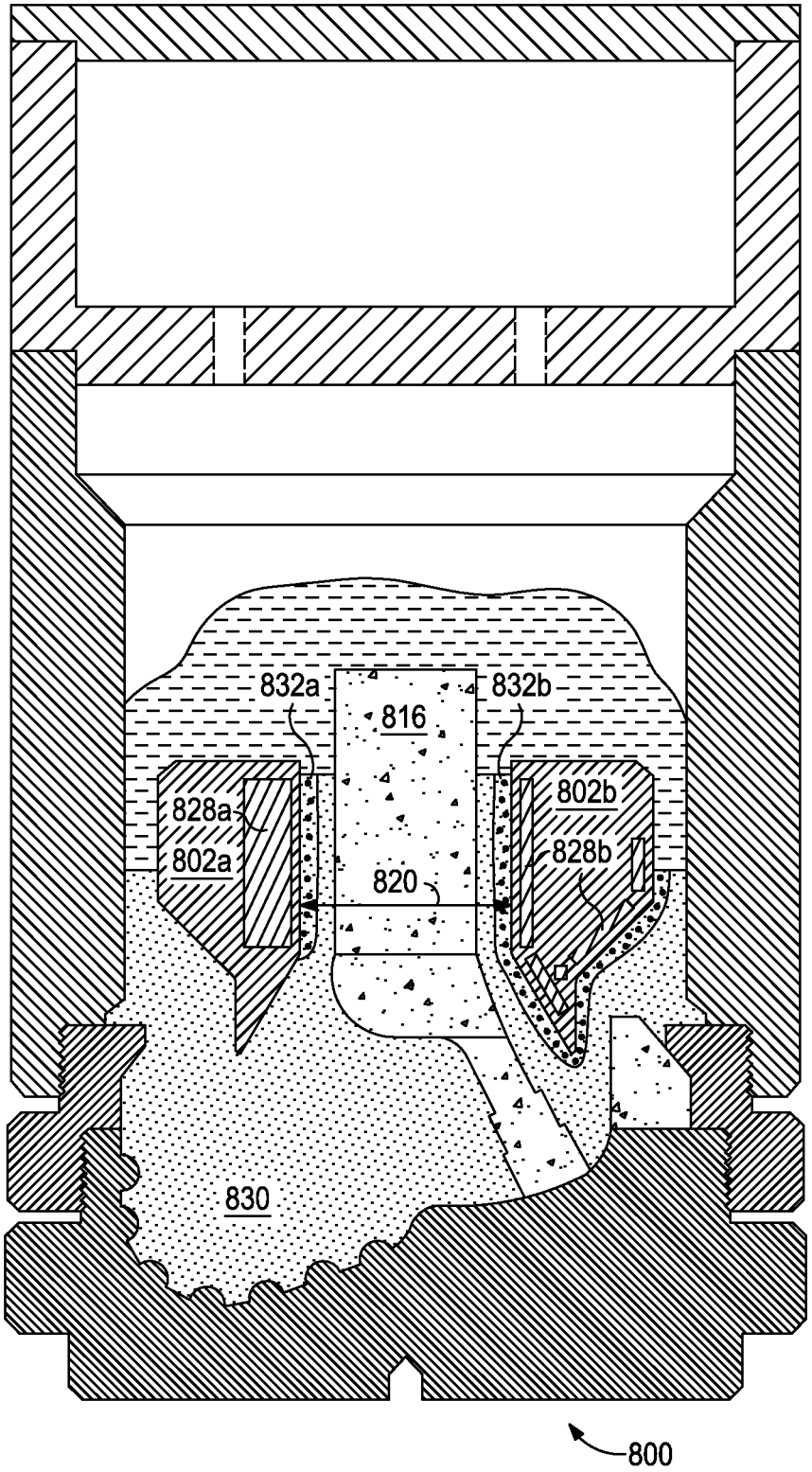
FIG. 8 is a cross-sectional side view of another exemplary mold assembly for use in forming the drill bit.

The use of magnetic reinforcing particles and/or magnetic partitioning barriers in selectively placing the reinforcing particles may result in a drill bit (or any MMC tool) that exhibits enhanced erosion resistance, increased impact strength, and mitigated crack propagation properties. FIGS. 6-8 describe other portions of the drill bit to which the foregoing methods using magnetic reinforcing particles and/or magnetic partitioning barriers may be employed. For brevity, the subsequent examples describe the use of magnetic reinforcing particles. However, from the foregoing disclosure, magnetic partitioning barriers may be used in combination with or as an alternative to magnetic reinforcing particles to selectively place reinforcing particles.

FIG. 6 is a cross-sectional side view of another exemplary mold assembly 600 for use in forming a drill bit. The illustrated mold assembly 600 includes one or more nozzle displacements or legs 614 (one shown) with a magnetic member 628 positioned therein. As a result, the magnetic reinforcing particles 632 may be preferentially located at or near the legs 614 and, consequently, at the flow passageway of the resultant drill bit. Because drilling fluids may include weighting materials like barite, the flow passageway may be prone to erosion resulting from the drilling fluid passing therethrough. Generally, larger reinforcing particles 618 provide for greater erosion-resistance. Therefore, in this illustrative example, the magnetic reinforcing particles 632 may be larger than the non-magnetic reinforcing particles 630. For example, the magnetic reinforcing particles 632 may be 100 microns to 1000 microns, and the non-magnetic reinforcing particles 630 may be 1 micron to 250 microns such that the magnetic reinforcing particles 632 are generally larger than the non-magnetic reinforcing particles 630.

FIG. 7 is a cross-sectional side view of another exemplary mold assembly 700 for use in forming a drill bit. The illustrated mold assembly 700 includes a central displacement 716 with a magnetic member 728 therein. As a result, the magnetic reinforcing particles 732 may be preferentially located along the surface of a fluid cavity of the metal blank 702. Like the flow passageway in the foregoing example, drilling fluid passing through the fluid cavity of the metal blank 702 may be prone to erosion. Therefore, the reinforcing particles 730 may be chosen and arranged so that the magnetic reinforcing particles 732 are generally larger than the non-magnetic reinforcing particle 730 and located at the surface of the fluid cavity.

FIG. 8 is a cross-sectional side view of another exemplary mold assembly 800 for use in forming a drill bit. The mold assembly 800 illustrates two embodiments for a metal blank 802*a*, 802*b* with a magnetic members 828*a*, 828*b* integral thereto. In the first illustrated embodiments, the metal blank 802*a* includes a magnetic member 828*a* positioned only in portion of the metal blank 802*a* that forms the inside diameter 820. Accordingly, the magnetic reinforcing particles 832*a* may be preferentially located along the inside diameter 820 of the metal blank 802.

In the second illustrated embodiment, the metal blank 802*b* includes magnetic members 828*b* integral to the metal blank 802*b* and extending along the surfaces of the metal blank 802*b* that will, once formed, interface with the hard composite portion of the final bit body. As a result, the magnetic reinforcing particles 832*b* may be preferentially located along at an interface between the metal blank 802*b* and the hard composite portion of the final bit body.

The interfaces between the metal blank 802*a*, 802*b* and the hard composite portion of the final bit body are subject to high amounts of torque during drilling and prone to cracking. Accordingly, the magnetic reinforcing particles 832*a*, 832*b* in these examples may be smaller than the non-magnetic reinforcing particles 830 and include elongated particles as previously described to increase impact strength and mitigate crack propagation.

Combinations of the foregoing examples may also be implemented to impart the desired enhanced erosion resistance, increased impact strength, and mitigated crack propagation properties to multiple portions of the hard composite portion of the drill bit. For example, FIGS. 6 and 7 may be combined to reduce erosion along the flow passageway and fluid cavity. In another example, FIGS. 3 and 8 may be combined to increase impact strength and mitigate crack propagation in the cutter blades and at the hard composite/metal blank interface. In yet another example, FIGS. 3 and 6-8 may be combined where two types of magnetic reinforcing particles are used to provide for the respective erosion resistance and impact strength enhancements. As would be apparent to one skilled in the art, the foregoing combinations may use the concepts illustrated in FIG. 4 or 5 in place of the concepts illustrated in FIG. 3. Further, the magnetic partitioning barrier methods may be implemented in the foregoing combinations.

Figure 9:
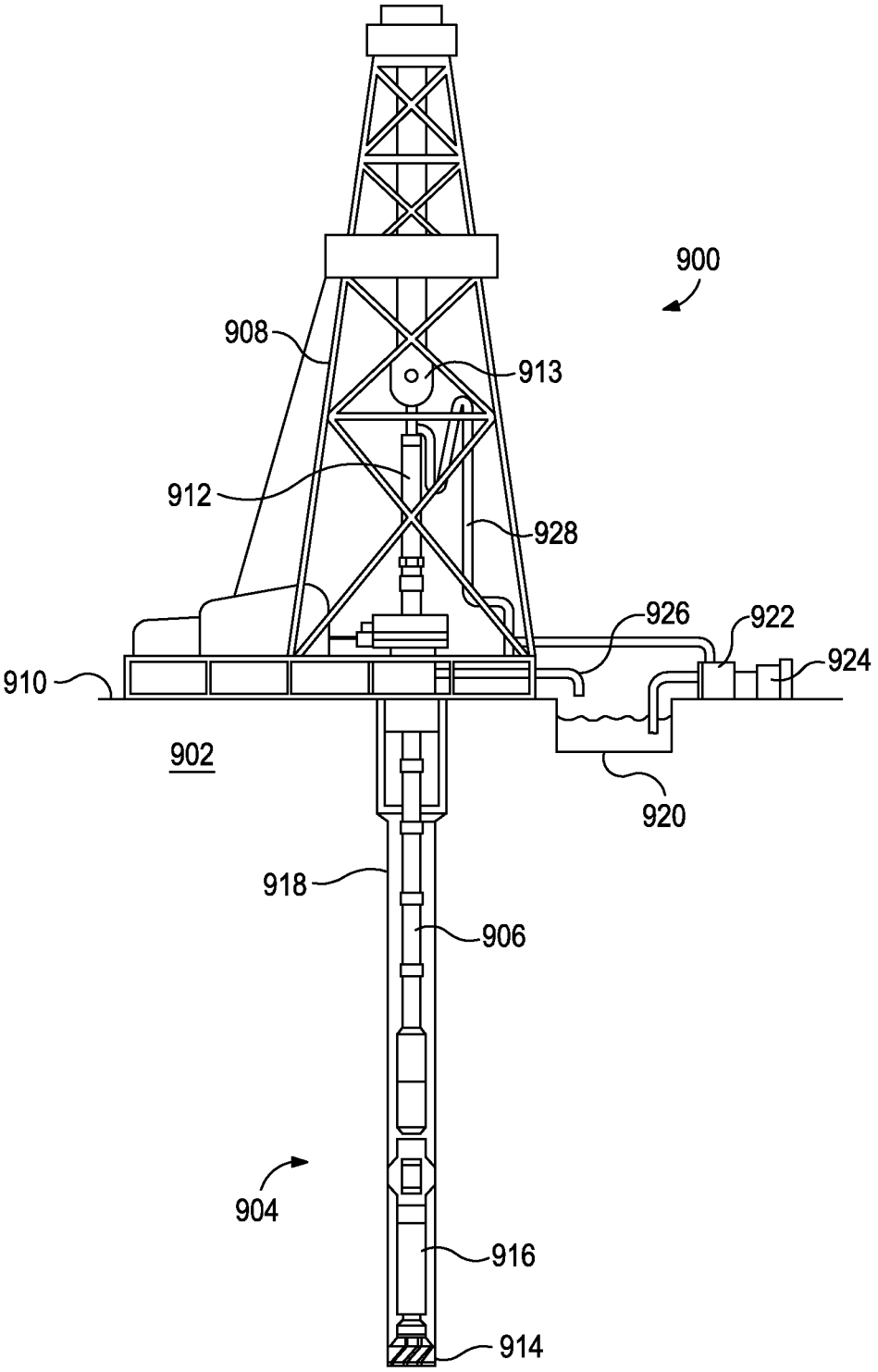
FIG. 9 is a schematic drawing showing a drilling assembly suitable for using a matrix drill bit in accordance with the present disclosure.

FIG. 9, illustrated is an exemplary drilling system 900 that may employ one or more principles of the present disclosure. Boreholes may be created by drilling into the earth 902 using the drilling system 900. The drilling system 900 may be configured to drive a bottom hole assembly (BHA) 904 positioned or otherwise arranged at the bottom of a drill string 906 extended into the earth 902 from a derrick 908 arranged at the surface 910. The derrick 908 includes a kelly 912 and a traveling block 913 used to lower and raise the kelly 912 and the drill string 906.

The BHA 904 may include a drill bit 914 operatively coupled to a tool string 916 which may be moved axially within a drilled wellbore 918 as attached to the drill string 906. The drill bit 914 may be fabricated and otherwise created in accordance with the principles of the present disclosure. During operation, the drill bit 914 penetrates the earth 902 and thereby creates the wellbore 918. The BHA 904 provides directional control of the drill bit 914 as it advances into the earth 902. The tool string 916 can be semi-permanently mounted with various measurement tools (not shown) such as, but not limited to, measurement-while-drilling (MWD) and logging-while-drilling (LWD) tools, that may be configured to take downhole measurements of drilling conditions. In other embodiments, the measurement tools may be self-contained within the tool string 916, as shown in FIG. 9.

Fluid or "mud" from a mud tank 920 may be pumped downhole using a mud pump 922 powered by an adjacent power source, such as a prime mover or motor 924. The mud may be pumped from the mud tank 920, through a stand pipe 926, which feeds the mud into the drill string 906 and conveys the same to the drill bit 914. The mud exits one or more nozzles arranged in the drill bit 914 and in the process cools the drill bit 914. After exiting the drill bit 914, the mud circulates back to the surface 910 via the annulus defined between the wellbore 918 and the drill string 906, and in the process, returns drill cuttings and debris to the surface. The cuttings and mud mixture are passed through a flow line 928 and are processed such that a cleaned mud is returned down hole through the stand pipe 926 once again.

Although the drilling system 900 is shown and described with respect to a rotary drill system in FIG. 9, those skilled in the art will readily appreciate that many types of drilling systems can be employed in carrying out embodiments of the disclosure. For instance, drills and drill rigs used in embodiments of the disclosure may be used onshore (as depicted in FIG. 9) or offshore (not shown). Offshore oil rigs that may be used in accordance with embodiments of the disclosure include, for example, floaters, fixed platforms, gravity-based structures, drill ships, semi-submersible platforms, jack-up drilling rigs, tension-leg platforms, and the like. It will be appreciated that embodiments of the disclosure can be applied to rigs ranging anywhere from small in size and portable, to bulky and permanent.

Further, although described herein with respect to oil drilling, various embodiments of the disclosure may be used in many other applications. For example, disclosed methods can be used in drilling for mineral exploration, environmental investigation, natural gas extraction, underground installation, mining operations, water wells, geothermal wells, and the like. Further, embodiments of the disclosure may be used in weight-on-packers assemblies, in running liner hangers, in running completion strings, etc., without departing from the scope of the disclosure.

Embodiments described herein include:

Embodiment A: a method comprising: placing reinforcement materials within an infiltration chamber of a mold assembly, the reinforcement materials comprising magnetic reinforcing particles and non-magnetic reinforcing particles; positioning one or more magnetic members relative to the mold assembly to selectively locate the magnetic reinforcing particles within the infiltration chamber with respect to the non-magnetic reinforcing particles; and infiltrating the reinforcement materials with a binder material to form a hard composite;

Embodiment B: a method comprising: positioning one or more magnetic members relative to a mold assembly; placing first reinforcing particles within an infiltration chamber of a mold assembly between a magnetic partitioning barrier positioned within the infiltration chamber and the one or more magnetic members; adding second reinforcing particles to the infiltration chamber opposite the magnetic partitioning barrier from the first reinforcing particles; and infiltrating the first and second reinforcing particles with a binder material to form a hard composite; and Embodiment C: a MMC tool comprising: a body having a hard composite portion that comprises a first portion that comprises magnetic reinforcing particles dispersed in a binder material and a second portion that comprises non-magnetic reinforcing particles dispersed in the binder material; and Embodiment D: a drill string extendable from a drilling platform and into a wellbore; the MMC tool of Embodiment C being a drill bit attached to an end of the drill string; and a pump fluidly connected to the drill string and configured to circulate a drilling fluid to the drill bit and through the wellbore.

Optionally, Embodiment A may include one or more of the following elements: Element 1: wherein positioning the one or more magnetic members relative to the mold assembly comprises positioning the one or more magnetic members within a portion of the mold assembly or a component thereof and thereby locating the magnetic reinforcing particles along inner surfaces of the infiltration chamber; Element 2: wherein positioning the one or more magnetic members relative to the mold assembly comprises positioning the one or more magnetic members external to the mold cavity and thereby locating the magnetic reinforcing particles along inner surfaces of the infiltration chamber; Element 3: wherein positioning the one or more magnetic members relative to the mold assembly comprises positioning the one or more magnetic members within one or more displacements arranged within the infiltration chamber, wherein the one or more displacements are selected from the group consisting of a nozzle displacement, a junk slot displacement, a central displacement, and a cutter-pocket displacement; and Element 4: wherein the wherein the non-magnetic reinforcing particles are first non-magnetic reinforcing particles, and wherein the magnetic reinforcing particles comprise second non-magnetic particles at least partially coated with a magnetic material. Exemplary combinations of the foregoing elements may include, but are not limited to, Element 1 in combination with Element 2; Element 1 in combination with Element 3; Element 2 in combination with Element 3; Elements 1-3 in combination; any of the foregoing in combination with Element 4; or Element 4 in combination with one of Elements 1-3.

Optionally, Embodiment B may include one or more of the following elements: Element 6: the method further including removing the magnetic partitioning barrier once a volume of the second reinforcing particles can physically maintain the first reinforcing particles in position; Element 7: wherein positioning the one or more magnetic members relative to the mold assembly comprises positioning the one or more magnetic members external to the mold cavity and the method further comprising positioning the magnetic partitioning barrier proximal to an inner surface of the infiltration chamber, thereby locating the first reinforcing particles along the inner surface of the infiltration chamber; Element 8: wherein positioning the one or more magnetic members relative to the mold assembly comprises positioning the one or more magnetic members as a portion of the mold assembly or a component thereof and thereby locating the magnetic reinforcing particles along inner surfaces of the infiltration chamber; and Element 9: wherein positioning the one or more magnetic members relative to the mold assembly comprises positioning the one or more magnetic members within one or more displacements arranged within the infiltration chamber, wherein the one or more displacements are selected from the group consisting of a nozzle displacement, a junk slot displacement, a central displacement, and a cutter-pocket displacement, and the method further comprising positioning the magnetic partitioning barrier proximal to a surface of the one or more displacements, thereby locating the first reinforcing particles along surfaces of the one or more displacements. Exemplary combinations of the foregoing elements may include, but are not limited to, Element 7 in combination with Element 8; Element 7 in combination with Element 9; Element 8 in combination with Element 9; Elements 7-9 in combination; any of the foregoing in combination with Element 6; or Element 6 in combination with one of Elements 7-9.

In some instances, Embodiments C and D may include wherein the MMC tool is a drill bit and the body is a bit body at least partially formed of the hard composite portion, the MMC tool further comprising: a plurality of cutting elements coupled to an exterior portion of the bit body. Optionally, Embodiment B may further include one or more of the following elements: Element 10: the MMC tool further comprising: a fluid cavity defined within the bit body; at least one flow passageway extending from the fluid cavity to the exterior portion of the bit body, wherein the first portion of the hard composite portion includes surfaces of the flow passageway and the first reinforcing particles are larger than the second reinforcing particles; and at least one nozzle opening defined by an end of the at least one flow passageway proximal to the exterior portion of the matrix bit body; Element 11: the MMC tool further comprising: a fluid cavity defined within the bit body, wherein the first portion of the hard composite portion includes surfaces of the fluid cavity and the first reinforcing particles are larger than the second reinforcing particles; at least one flow passageway extending from the fluid cavity to the exterior portion of the bit body; and at least one nozzle opening defined by an end of the at least one flow passageway proximal to the exterior portion of the matrix bit body; Element 12: the MMC tool further comprising: a plurality of cutter blades formed on an exterior portion of the matrix bit body, the plurality of cutting elements being arranged on the plurality of cutter blades; and a plurality of pockets formed in the plurality of cutter blades, wherein the first portion of the hard composite portion includes surfaces of the pockets and the first reinforcing particles are larger than the second reinforcing particles; and Element 13: the MMC tool further comprising: a plurality of cutter blades formed on an exterior portion of the matrix bit body, the plurality of cutting elements being arranged on the plurality of cutter blades; and a plurality of pockets formed in the plurality of cutter blades, wherein the first portion of the hard composite portion includes surfaces of the pockets and the second reinforcing particles comprise fibers. Exemplary combinations of the foregoing elements may include, but are not limited to, Element 10 in combination with Element 11; Element 10 in combination with Element 12; Element 10 in combination with Element 13; Element 11 in combination with Element 12; Element 11 in combination with Element 13; Element 12 in combination with Element 13; and three or more of Elements 10-13 in combination.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A method comprising:

placing reinforcement materials within an infiltration chamber of a mold assembly, the reinforcement materials comprising magnetic reinforcing particles and non-magnetic reinforcing particles;

positioning one or more magnetic members relative to the mold assembly to selectively locate the magnetic reinforcing particles within the infiltration chamber with respect to the non-magnetic reinforcing particles; and infiltrating the reinforcement materials with a binder material to form a hard composite after selectively locating the magnetic reinforcing particles within the infiltration chamber.

2. The method of claim 1, wherein positioning the one or more magnetic members relative to the mold assembly comprises positioning the one or more magnetic members within a portion of the mold assembly or a component thereof and thereby locating the magnetic reinforcing particles along inner surfaces of the infiltration chamber.

3. The method of claim 1, wherein positioning the one or more magnetic members relative to the mold assembly comprises positioning the one or more magnetic members external to the mold cavity and thereby locating the magnetic reinforcing particles along inner surfaces of the infiltration chamber.

4. The method of claim 1, wherein positioning the one or more magnetic members relative to the mold assembly comprises positioning the one or more magnetic members within one or more displacements arranged within the infiltration chamber, wherein the one or more displacements are selected from the group consisting of a nozzle displacement, a junk slot displacement, a central displacement, and a cutter-pocket displacement.

5. The method of claim 1, wherein the non-magnetic reinforcing particles are first non-magnetic reinforcing particles, and wherein the magnetic reinforcing particles comprise second non-magnetic particles at least partially coated with a magnetic material.

6. A method comprising:

positioning one or more magnetic members relative to a mold assembly;

placing first reinforcing particles within an infiltration chamber of the mold assembly between a magnetic partitioning barrier positioned within the infiltration chamber and the one or more magnetic members;

adding second reinforcing particles to the infiltration chamber opposite the magnetic partitioning barrier from the first reinforcing particles; and infiltrating the first and second reinforcing particles with a binder material to form a hard composite.

7. The method of claim 6 further comprising:

removing the magnetic partitioning barrier once a volume of the second reinforcing particles can physically maintain the first reinforcing particles in position.

8. The method of claim 6, wherein positioning the one or more magnetic members relative to the mold assembly comprises positioning the one or more magnetic members external to the mold cavity and the method further comprising positioning the magnetic partitioning barrier proximal to an inner surface of the infiltration chamber, thereby locating the first reinforcing particles along the inner surface of the infiltration chamber.

9. The method of claim 6, wherein positioning the one or more magnetic members relative to the mold assembly comprises positioning the one or more magnetic members as a portion of the mold assembly or a component thereof and thereby locating the magnetic reinforcing particles along inner surfaces of the infiltration chamber.

10. The method of claim 6, wherein positioning the one or more magnetic members relative to the mold assembly comprises positioning the one or more magnetic members within one or more displacements arranged within the infiltration chamber, wherein the one or more displacements are selected from the group consisting of a nozzle displacement, a junk slot displacement, a central displacement, and a cutter-pocket displacement, and the method further comprising positioning the magnetic partitioning barrier proximal to a surface of the one or more displacements, thereby locating the first reinforcing particles along surfaces of the one or more displacements.

11. A metal matrix composite (MMC) tool comprising:

a body having a hard composite portion that comprises a first portion and a second portion that comprises magnetic reinforcing particles and non-magnetic reinforcing particles at least partially coated with a magnetic material, and non-magnetic reinforcing particles in the first portion and the second portion dispersed in a binder material.

12. The MMC tool of claim 11, wherein the MMC tool is a drill bit and the body is a bit body at least partially formed of the hard composite portion, the MMC tool further comprising: a plurality of cutting elements coupled to an exterior portion of the bit body.

13. The MMC tool of claim 12 further comprising:

a fluid cavity defined within the bit body;

at least one flow passageway extending from the fluid cavity to the exterior portion of the bit body, wherein the first portion of the hard composite portion includes surfaces of the flow passageway and the first reinforcing particles are larger than the second reinforcing particles; and at least one nozzle opening defined by an end of the at least one flow passageway proximal to the exterior portion of the matrix bit body.

14. The MMC tool of claim 12 further comprising:

a fluid cavity defined within the bit body, wherein the first portion of the hard composite portion includes surfaces of the fluid cavity and the first reinforcing particles are larger than the second reinforcing particles;

at least one flow passageway extending from the fluid cavity to the exterior portion of the bit body; and at least one nozzle opening defined by an end of the at least one flow passageway proximal to the exterior portion of the matrix bit body.

15. The MMC tool of claim 12 further comprising:

a plurality of cutter blades formed on an exterior portion of the matrix bit body, the plurality of cutting elements being arranged on the plurality of cutter blades; and a plurality of pockets formed in the plurality of cutter blades, wherein the first portion of the hard composite portion includes surfaces of the pockets and the first reinforcing particles are larger than the second reinforcing particles.

16. The MMC tool of claim 12 further comprising:

a plurality of cutter blades formed on an exterior portion of the matrix bit body, the plurality of cutting elements being arranged on the plurality of cutter blades; and a plurality of pockets formed in the plurality of cutter blades, wherein the first portion of the hard composite portion includes surfaces of the pockets and the second reinforcing particles comprise fibers.

* * * * *